United States Patent [19]

Holland-Letz

[11] 4,167,346

[45] Sep. 11, 1979

[54] APPARATUS FOR THE TIMED TRANSPORTING OF FORMS

[75] Inventor: Güenter Holland-Letz, Paderborn, Fed. Rep. of Germany

[73] Assignee: Nixdorf Computer AG, Paderborn, Fed. Rep. of Germany

[21] Appl. No.: 822,389

[22] Filed: Aug. 8, 1977

[30] Foreign Application Priority Data

Aug. 19, 1976 [DE] Fed. Rep. of Germany ..... 2537402

[51] Int. Cl.[2] ..... B41J 15/00

[52] U.S. Cl. ..... 400/618; 400/616.1; 400/584

[58] Field of Search ..... 197/126 A, 127 R, 128, 197/133 R, 133 A, 133 F, 133 P, 133 T, 138 A

[56] References Cited

U.S. PATENT DOCUMENTS

| | | | |
|---|---|---|---|
| 2,094,011 | 9/1937 | Helmond | 197/138 A |
| 2,199,556 | 5/1940 | Carroll | 197/133 R |
| 3,027,992 | 4/1962 | Runde et al. | 197/128 |
| 3,323,700 | 6/1967 | Epstein et al. | 197/133 R UX |
| 3,334,722 | 8/1967 | Bernard | 197/133 R |
| 3,440,955 | 4/1969 | Howard et al. | 197/133 R X |
| 3,550,745 | 12/1970 | Bisone et al. | 197/133 R |
| 3,586,149 | 6/1971 | Miller | 197/133 R |
| 3,802,546 | 4/1974 | Helms | 197/133 R |
| 3,837,461 | 9/1974 | Waibel | 197/126 A |
| 3,919,936 | 11/1975 | Barrus et al. | 197/133 R X |
| 3,935,938 | 2/1976 | Hodne | 197/133 R X |
| 4,011,811 | 3/1977 | Kodis | 197/133 R X |

*Primary Examiner*—Ernest T. Wright, Jr.
*Attorney, Agent, or Firm*—Gifford, Chandler, Van Ophem, Sheridan & Sprinkle

[57] ABSTRACT

Apparatus for the timed transporting of forms over the writing beam of a printing device, comprising a transporting device mounted downstream of the writing beam for causing the forms to make a timed movement of advance. At least one brake flap is biased so that a free end of the brake flap engages, in use, a form passing over the writing beam, immediately upstream of the writing or printing area. A lifting device is associated with each brake flap for lifting the brake flap away from the form during transport of the form to thereby frictionally release the form.

21 Claims, 7 Drawing Figures

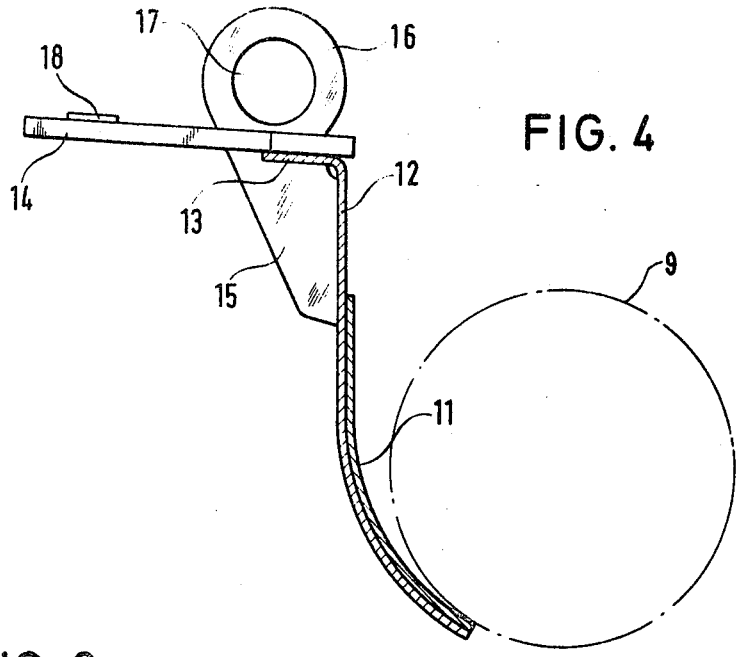
FIG. 4
FIG. 6
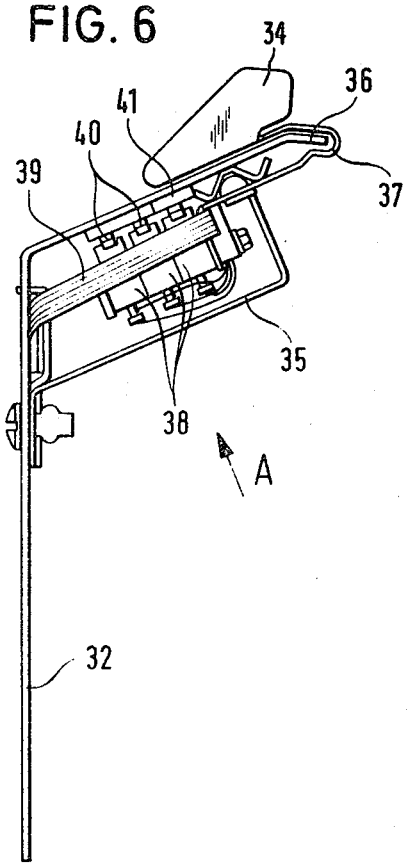
FIG. 3
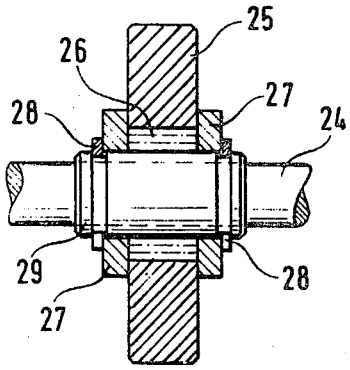

APPARATUS FOR THE TIMED TRANSPORTING OF FORMS

BACKGROUND OF THE INVENTION

I. Field of the Invention

The invention relates to an apparatus for the timed transporting of forms, preferably continuous forms, over the writing beam of a printing device, with a transporting device mounted at the delivery end for the forms and causing the forms to advance at timed intervals, and with a braking device mounted at the entry end for the forms and serving to hold the form taut on the writing beam.

II. Description of the Prior Art

In known apparatus for the kind described above, the form is pulled away from a pile located below and drawn around a roller-shaped writing beam, forming looping angles of up to 180°. Transporting is effected by means of a form transporting device mounted downstream of the writing beam at the delivery end for the forms, e.g. by means of a set of spiked belts. Transporting devices of this kind are known by the name "Leporello". At the entry end upstream of the writing beam is mounted a paper brake which ensures that the forms, particularly multiple sets of forms, abut on the writing area under mechanical tension. In these known constructions, the breaking elements are constantly pressed against the form by springs or, alternatively, under their own weight. Braking devices of this kind with a static effect have proved unsatisfactory, inasmuch as even small braking forces cause relatively high tensile stresses in the transporting of the forms when they loop round the writing beam, owing to the friction of the loop, and in many cases this results in the tearing of the transporting perforations. Moreover, when multiple sets of forms are being transported round the writing beam, the stitching comes undone and the transporting perforations move out of alignment, which may result in these perforations becoming detached, for example, from the spikes of the set of spiked belts. Furthermore, the different circumferential lengths of the inner and outer sheets of forms in a multiple set, when there is a large looping angle about the writing beam, causes the inner form sheets to buckle between the stitching, and, when the forms are being transported under tension, this together with the friction of the loop acting on the inner form sheets can result in breakage of the stitching.

On the other hand, however, it is essential for the writing or printing operation that the form sheets be securely held and stopped on the writing beam, since the printer exerts forces which act backwards and forwards on the form and could cause harmful movement or slipping of these forms if they were not adequately held.

SUMMARY OF THE INVENTION

The present invention provides an apparatus of the kind described above in which it is ensured, on the one hand, that even multiple forms or form materials which present problems in themselves can be transported precisely and, on the other hand, the forms can be held firmly and in a non-slip manner on the printing or writing area, with particular regard to apparatus which enables several forms to be processed at the same time.

According to the invention, there is provided apparatus for the timed transporting of forms over the writing beam of a printing device, comprising a transporting device mounted downstream of the writing beam for causing the forms to make a timed movement of advance; at least one brake flap biased so that a free end of the brake flap engages, in use, a form passing over the writing beam, immediately upstream of the writing or printing area and a lifting device associated with the or each brake flap for lifting the brake flap away from the form during transport of the form. The lifting devices are preferably constructed as electromagnets which can be activated during the transporting cycle.

The invention enables the brake flaps which are preferably pressed against the form by springs, e.g. torsion springs, to be lifted away from the form during the timed transporting movements, whereby the friction of the loop on the writing beam can be limited to the minimum. On the other hand, the form is held in place and arrested immediately beside the printing or writing area by the brake flaps which are under spring tension, during the printing or writing process, i.e., when displacement forces are acting on the form, and there is the advantage that the brake flaps can extend with their free ends, which preferably comprise friction coatings, to a point immediately beside the printing area. The invention ensures, in particular, that multiple forms do not slip with respect to each other or become separated or buckle during transporting, since the friction forces are limited to a minimum during this transporting.

According to one embodiment of the invention, each brake flap is rotatable about a brake axis and has an associated electromagnet, the movable armature of which is formed by that end of the brake opposite the free end. Owing to the fact that the brake flaps are not all operated together but that each brake flap has its own individually associated electromagnet, i.e., its own lifting device, it is possible to transport several forms, e.g. several continuous forms, at the same time with different degrees of advance, whilst a number of brake flaps can be associated with one form and a different number of brake flaps with the other form.

According to a further development of the invention, each brake flap forms, together with its brake axis, the electromagnet and a magnet yoke ending at the brake axis, a constructional unit which is individually pivotal about a pivot axis away from the form guide path. The formation of constructional units of this kind makes it substantially easier to mount them inside the apparatus, on the one hand, and on the other hand it is possible to pivot these units away from the form guide path in order to feed in or put in forms.

According to another embodiment of the invention, several marginal stops determining the guide path of the forms and movably mounted on an axis perpendicular to the direction of advance of the forms are provided at the entry for the forms upstream of the brake flaps, which marginal stops can be set in pairs to fit the edges of the forms. According to a preferred embodiment, the marginal stops are carriers for switching elements functionally associated with the brake flaps or the electromagnets thereof, and which elements determine the individual association of the different brake flaps with the forms being transported simultaneously parallel to one another, depending on the width setting of the marginal stops. The switching elements are actuated by control means which identify their particular positions and the switching signal can be used to select the brake flap magnets which are or should be associated with the individual forms running parallel to one another and can also be used for functionally coupling the forms with the advance transporting devices associated with the individual forms, for example by means of an electronic control device, without any need for a manually switched change-over in the electrical distributor plan for the brake flap magnets.

An improvement to he above-mentioned device for selecting the individual brake flap magnets is provided, according to another embodiment of the invention, in that there is mounted, in the displacement track of the switching contacts of the switching elements, fastened in particular to the central marginal stops of two pairs of marginal stops determining two form guiding paths, a control plate extending parallel to the displacement axis and provided with control stages corresponding to the subdivision of the brake flaps, by means of which control stages the switching elements are actuated and thus the brakes flaps are individually associated with the different form guiding paths. The marginal stops, preferably the inner marginal stops of two pairs of marginal stops, are moved along the control plate, whilst switching operations automatically take place at the control stages, preferably in the center of the gap between two brake flaps, these switching operations identifying the position of the marginal stops and thus enabling the brake flaps to be associated with the individual form guiding paths which may be of any desired width within the overall width of the device. At the same time, the solenoids of these brake flaps are electrically coupled to the relevant transporting drives for individually controlling the advance of the advance movements or timed movements of the individual forms which may be different for each individual form, for example.

According to a further embodiment of the invention, several braking rollers are mounted at the entry for the forms, preferably in the region between the marginal stops and the brake flaps, these braking rollers resting on the form or forms being transported and causing mechanical tension in the forms. In order to adapt to different form material or different thicknesses of forms, braking rollers of different weights, preferably with bearing bores of different widths and rotable about a bearing axis can be pushed up and arrested between clamping discs. These braking rollers which can be raised manually, according to the invention, perhaps in order to insert new forms from the form guiding path, are otherwise constantly in contact with the form or forms and exert suitable tension for each form via a selected number of weights, during the transporting of the form. Thus, even when the brake flaps are raised, it is impossible for the forms to slip or become distorted; rather, they are always clamped taut.

It should be stressed that the cooperation of the inventive features, particularly the functional cooperation of the brake flaps which are individually movable by means of lifting devices and the above-mentioned device for selecting these brake flaps by means of the marginal stops, according to the width of the forms, provides a device which enables the forms to be transported exactly and which is suitable for processing forms of all kinds and in any desired quantity without any mechanical or electrical rearrangement.

BRIEF DESCRIPTION OF THE DRAWING

In the accompanying drawing:

FIG. 3 is a detail from the apparatus of FIG. 1;

FIG. 4 is another detail of the apparatus of FIG. 1 in section and on an enlarged scale;

FIG. 6 is a side view of the partial assembly of FIG. 5, and;

DETAILED DESCRIPTION OF THE PRESENT INVENTION

Figure 1:
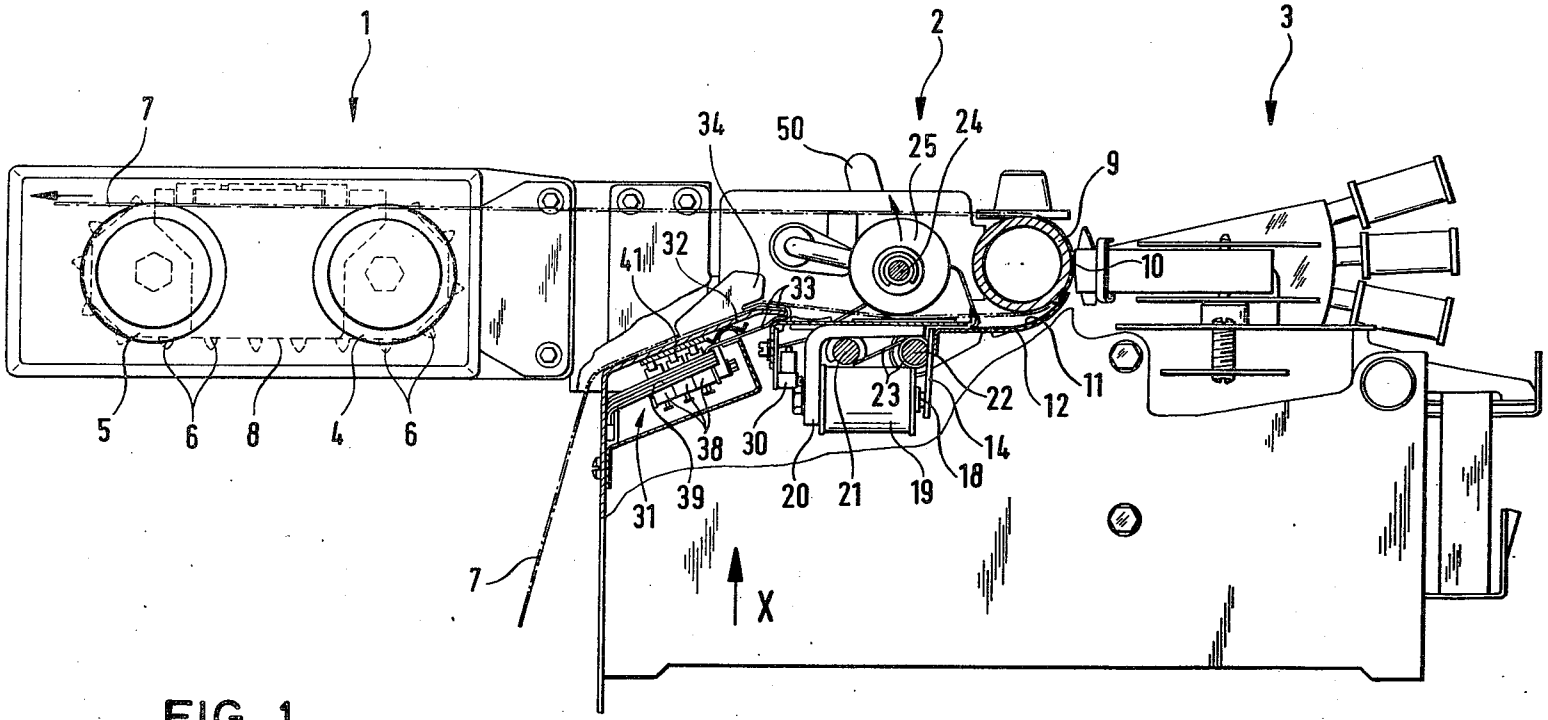
FIG. 1 is a side view, in section, of an embodiment of an apparatus according to the invention.

The apparatus shown in FIG. 1 basically consists of three main parts, namely a transporting device 1 which is known under the name "Leporello" drive, a form feeding and preparing device 2 and a printing or writing device 3, e.g. a so-called stylus printer of known construction. The structure and method of operation of the form feeding and preparing device 2 is explained in detail hereinafter; the other parts 1 and 3 of the apparatus are described only so far as is necessary for understanding the invention.

The transporting device 1 comprises, for example, two or more spiked belts 8 provided with transporting spikes 6 and running on transporting rollers 4, 5 and spaced apart from one another depending on the width of the forms or having spacings from one another which can be individually adjusted. The transporting rollers 4, 5 are driven by a single drive apparatus, or, if multiple forms are being transported, by several drive apparatus for transporting the forms, which forms are generally designated 7, in the direction of the arrow. The drive is effected by moving the forms 7 in the direction of the arrow at timed intermittent intervals, depending on the time taken for the printing device 3 to print a line, whilst when transporting multiple forms the spiked belt 8 or sets of spiked belts associated with the individual forms, preferably continuous forms, can be driven at different speeds of advance depending on the different line spacings of these forms. For this purpose, the forms 7 comprise perforations on one or both longitudnal edges in which the transporting spikes 6 can engage.

The form feeding and preparing device 2 comprises a fixed tubular writing beam 9 which the type of the printing device 3 faces. The line of contact between the writing beam 9 and printing device 3 is hereinafter termed a writing or printing area 10. In FIG. 1, the forms and form guiding paths are shown by double dotted lines and are designated 7. The forms, e.g. the continuous form 7, loop around the writing beam 9 through an angle of 180°, driven by the transporting device 1. Immediately upstream of and below the writing beam 9 are mounted several brake flaps 12 which comprise, on their curved free end, friction linings 11, these free ends extending to immediately beside the writing area 10.

FIG. 4 shows a brake flap 12 on an enlarged scale. It is fastened, e.g. welded, at one end 13 to an armature plate 14 and comprises bent side pieces 15 which form a bearing projection 16 with a pivot bore 17. The armature plate 14 comprises an armature contact 18. Each of these brake flaps 12 has an associated electromagnet 19 (FIG. 1) to the yoke 20 of which are fastened bearings shafts 21 and 22, for example by means of screws, whilst the bearing shafts 21, 22 extend over the entire transporting width of the forms 7. The brake flaps 12 and armature plates 14 with the bearing projections 16 are mounted on the bearing shaft 22 and biased towards the writing beam 9 by means of helical springs 23. The individual constructional units, each consisting of electromagnet 19, yoke 20, armature plate 14 and brake flap 12 can be lowered about the bearing shaft 21, by means of a lever (not shown) so as to enable new forms 7 to be put in, for example.

Several braking rollers 25 are mounted on a bearing shaft 24 arranged above the lower form guiding path, this bearing shaft 24 extending over the entire width of the device, as do the bearing shafts 21, 22. The bearing shaft 24 can be raised in the direction of the arrow together with the braking rollers 25 by means of a hand operated lever 50 and can be lifted up from the form transporting path. As shown in the sectional view of FIG. 3, the breaking rollers 25 which load down the forms 7 with their weight and thus tighten them in position comprise a bearing bore 26 shown by dotted lines and of greater or lesser diameter depending on the greater or lesser weight required for the correct tightening of the form 7. The braking rollers 25 are mounted between clamping discs 27 and securing discs 28 which in their turn are mounted on a bearing sleeve 29 which is axially movable on the bearing shaft 24.

Reference numeral 30 (FIG. 1) indicates a switching element of known construction which constitutes an indicator for the end of the forms 7.

At the start of the entry for the forms 7 is provided a selecting device 31 for the electromagnets 19 of the individual brake flaps 12 (five, in the exemplary embodiment). In the exemplary embodiment, four marginal stops 33 with ear-like stop projections 34 are mounted so as to be partly movable perpendicular to the form guiding path, on a guide plate 32 which determines the form guiding path.

Figure 5:
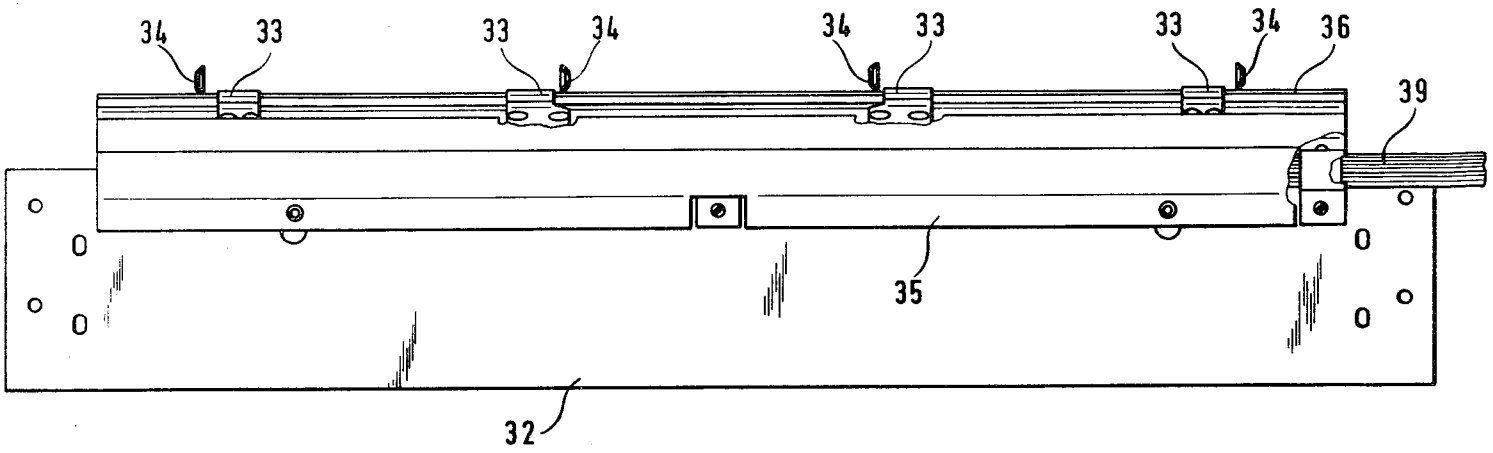
FIG. 5 is front view of a partial assembly from the apparatus of FIG. 1.

This selecting device 31 will be described with reference to FIGS. 5, 6 and 7. The FIGS. 5 and 6 show the guide plate 32 with a housing 35 mounted thereon and with a free guide edge 36 of the guide plate 32. The marginal stops 33 (four in the exemplary embodiment) (see FIG. 5) form two pairs of marginal stops, the stop projections 34 of which have funnel-shaped widened ends for inserting the forms 7. The marginal stops 33 comprise sliding projections 37 which engage around the guide edge 36 acting as a slide rail. In the exemplary embodiment, three microswitches 38 are fixed to the extensions of the sliding projections 37 of the two inner marginal stops 33 of the pairs of marginal stops 33, these switches 38 being electrically connected to the drive and transporting device 1 by means of a flexible cable strip 39 and a control device (not shown). The marginal stops 33 can be set exactly to the width of the two continuous forms 7 being transported parallel to one another. Preferably, only the two inner marginal stops 33 are adjustable; the other marginal stops 33 always remain in the same position. Therefore, in the exemplary embodiment, only these inner marginal stops 33 have switching elements, the switching contacts 40 of which comprise V-shaped bent ends and can be actuated from two opposite directions.

Figure 7:
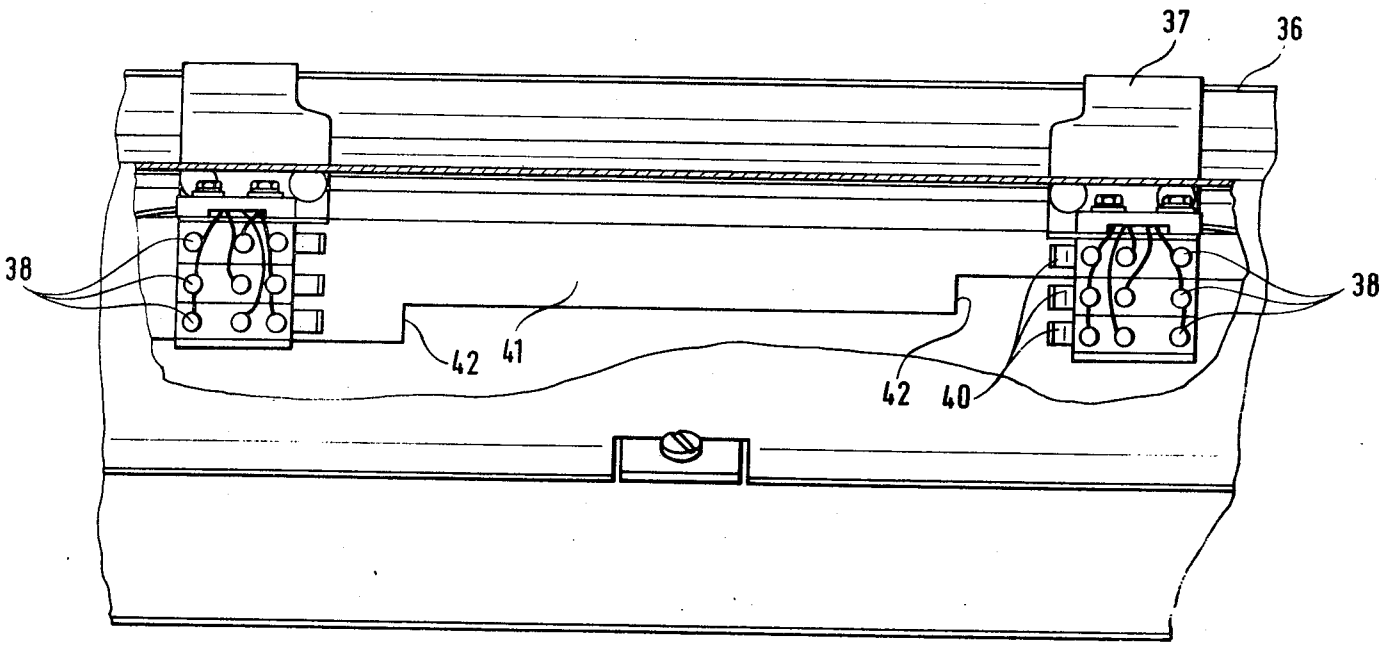
FIG. 7 is the device indicated at A in FIG. 6.

In FIGS. 6 and 7, reference numeral 41 designates a control plate which comprises control stages 42 (FIG. 2, 7) at the level of the micro-switches 38 mounted side by side. This control plate 41 extends, as shown particularly in FIGS. 6 and 7, above the micro-switches 38 in the area of actuating the switching contact 40.

Figure 2:
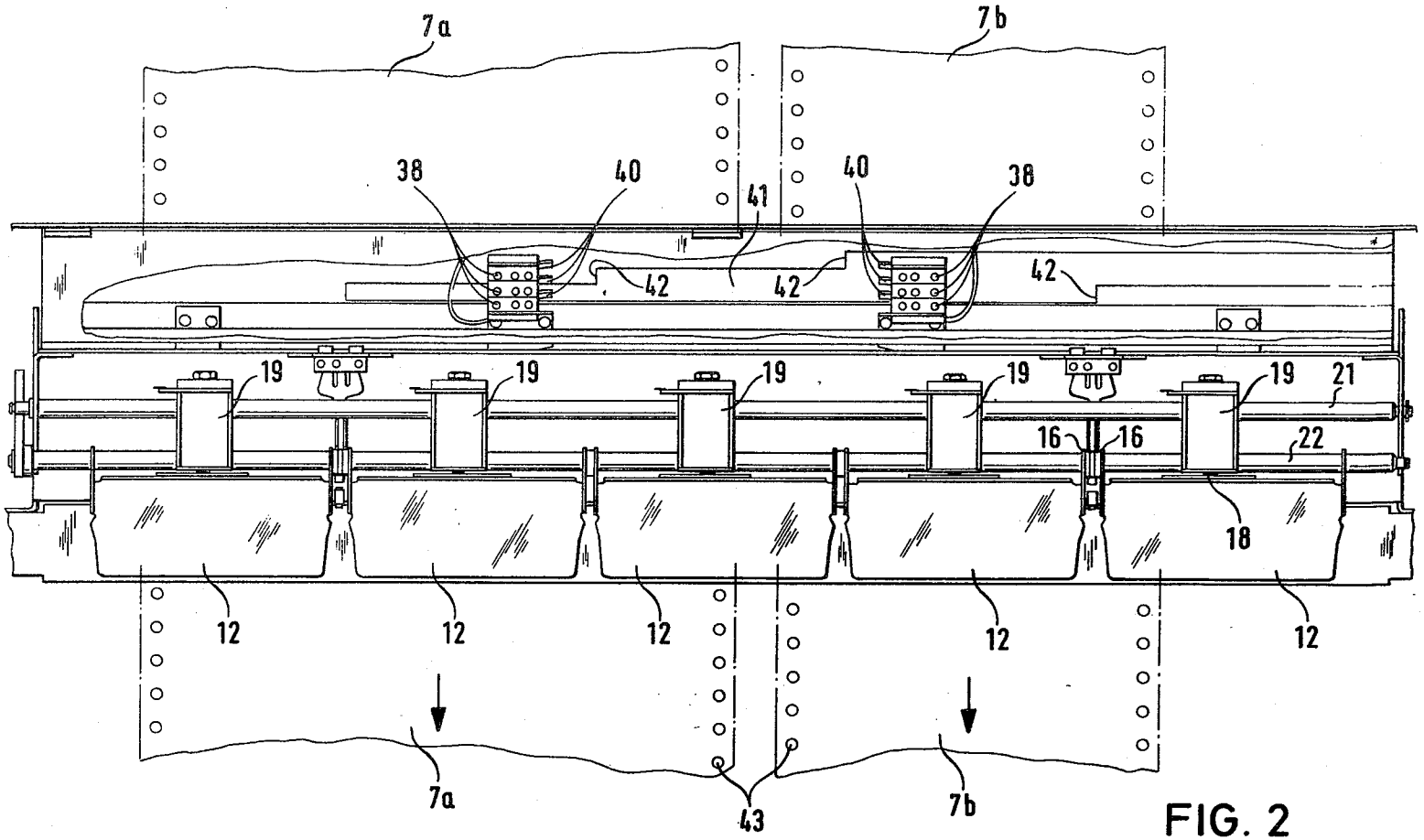
FIG. 2 is an enlarged bottom view of part of the apparatus shown at X in FIG. 1.

FIG. 2 shows, particularly clearly, the fixed control plate 41 with its stepped control stages 42 which are located in the plane of movement of the corresponding micro-switches 38. If the marginal stops 33 or their switching contacts 40 move across the center of the gap between two brake flaps 12, i.e., across the site of the control stages 42, when they are adjusted to the longitudinal edges of two forms *7a* and *7b* of different widths and having differently divided perforations 43, a switching operation occurs since the relevant switching contact 40 runs onto the control stage 42 or falls away from it. Accordingly, a switching impulse is released which identifies the particular position in association with the brake flaps 12, i.e., selects the brake flap 12 to which the form *7a* or *7b* belongs and the transporting cycle with which these selected brake flaps 12 are to be actuated by the form drives electrically connected to the micro-switches 38, depending on the different subdivisions of the form. FIG. 2 also shows the construction of the free curved ends of the brake flaps 12, viewed from below, and the bearing shafts 21, 22 for the units consisting of electromagnet 19, magnet yoke 20 (FIG. 1) and the brake flap 12. The method of operation of the apparatus described above will now be explained.

First of all, the marginal stops 33, preferably the two inner marginal stops of the pairs of marginal stops are set to the width of the forms *7a* and *7b*. At the same time, the brake flaps 12 are selected in the manner described above and associated with one form *7a* and the other form *7b*. After the braking rollers 25, which can be spread over both forms *7a* and *7b* by axial adjustment, have been pivoted upwards and the units consisting of electromagnet 19, magnet yoke 20, armature plate 14 and brake flap 12 have been lowered, the forms *7a, 7b* are placed in the form guiding path until the transporting spikes 6 of the transporting device 1 are in engagement with the perforations 43 of the forms *7a* and *7b*. The forms *7a, 7b* are then transported at time intervals in the direction of the arrow (FIG. 1), whilst after each timed step the printing device 3 is actuated to print a line. During this transporting movement, the electromagnets 19 are activated and the brake flaps 12 are raised from the forms abutting on the writing beam 9 and which forms are clamped by the braking rollers 25, by attracting the armature plates 14, and thus at least countering the majority of the compressive force exerted by the brake flaps. At the end of the timed movement, the electromagnets 19 are deactivated, the armature plates 14 fall away and the brake flaps 12 rest with their full compressive force, caused by the torsion springs 23, on the forms *7a* and *7b* and hold them so that a writing or printing operation can take place without any danger of the forms *7a* and *7b* slipping.

I claim:

1. Apparatus for the timed transporting of forms over a writing beam of a printing device, comprising a transporting device mounted downstream of the writing beam for causing the forms to make a timed movement of advance; at least one brake flap biased so that a free end of the brake flap engages, in use, a form passing over the writing beam, immediately upstream of the writing or printing area and a lifting device associated with the or each brake flap for lifting the brake flap away from the form during transport of the form, said apparatus having an entry for the forms upstream of the brake flaps, a plurality of marginal stops positioned at the entry for the forms, at least some of which are movably mounted on a track extending perpendicular to the direction of advance of the forms, these marginal stops determining the guide path for the forms and being capable of being set in pairs to fit the edges of the forms and wherein at least some of the marginal stops have switching elements mounted thereon, functionally associated with the brake flaps and wherein the switching elements determine the individual association of the different brake flaps with forms being transported simultaneously and parallel to one another, depending on the position of the marginal stops on the track.

2. Apparatus according to claim 1, wherein the lifting device comprises an electromagnet.

3. Apparatus according to claim 2, wherein the or each flap brake is pivotable about a bearing shaft by a movable armature of the electromagnet which is formed by the end of the brake flap opposite the free end.

4. Apparatus according to claim 3, wherein the brake flap forms, together with its bearing shaft, the electromagnet and a magnet yoke, a constructional unit which is pivotable about a bearing shaft away from the form guiding path.

5. Apparatus according to claim 4, wherein a plurality of said construtional units are mounted on a common bearing shaft perpendicular to the direction of advance of the forms.

6. Apparatus according to claim 1, wherein each switching element includes at least one switching contact and wherein, in the path of movement of the switching contacts of the switching elements is mounted a control plate extending parallel to the path of movement and provided with control stages corresponding to the subdivision of the brake flaps, by means of which control stages the switching elements are actuated and hence the brake flaps are individually associated with the different form guiding paths.

7. Apparatus according to claim 6, comprising two pairs of marginal stops, defining two form guiding paths, wherein switching elements are mounted on the two inner marginal stops.

8. Apparatus according to claim 7, wherein the outer marginal stops of the two pairs of marginal stops are fixedly mounted and only the inner marginal stops carrying the switching elements are movable along a stepped control track of the control plate and can be set to the edges of the forms.

9. Apparatus according to claim 8, wherein a plurality of switching elements are associated with the individual control stages, the number of switching elements corresponding to the number of control stages, and the brake flaps are electrically connected to the inner marginal stops.

10. Apparatus according to claim 9, wherein the switching elements are provided with V-shaped contacts and are actuatable in two opposite directions and these contacts are electrically connected to the brake flaps.

11. Apparatus according to claim 1, wherein a plurality of braking rollers are mounted upstream of the writing beam which rest on the form or forms being transported and cause the forms to be mechanically clamped.

12. Apparatus according to claim 11 wherein said braking rollers rest on the form or forms between the marginal stops and the brake flaps.

13. Apparatus according to claim 11, wherein the braking rollers are mounted on a common bearing axle extending perpendicular to the form guiding path, and the bearing axle can be lifted up from the form guiding path by means of a hand operated lever.

14. Apparatus according to claim 11, wherein the braking rollers are axially movable on the bearing axle.

15. Apparatus according to claim 11, wherein the braking rollers are of different weights and the position of the braking rollers axially along the bearing axle is adjustable.

16. Apparatus according to claim 1, wherein at least the free ends of the at least one brake flap has a friction coating.

17. Apparatus for the timed transporting of forms over a writing beam of a printing device, comprising a transporting device mounted downstream of the writing beam for causing the forms to make a timed movement of advance; at least one brake flap biased so that a free end of the brake flap engages, in use, a form passing over the writing beam, immediately upstream of a writing or printing area and a lifting device associated with the or each brake flap for lifting the brake flap away from the form during the transport of the form, wherein the lifting device comprises an electromagnet, wherein the or each brake flap is pivotable about a bearing shaft and wherein the lifting device further comprises a movable armature which cooperates with the electromagnet and which is secured to an end of the brake falp opposite the free end of the brake flap, wherein the brake flaps form, together with its bearing shaft, the electromagnet and a magnet yoke, a constructional unit which is pivotable about a bearing shaft away from the form guiding path, wherein a plurality of said constructional units are mounted on a common bearing shaft perpendicular to the direction of advance of the forms, wherein at the entry for the forms, upstream of the brake flaps, are provided a plurality of marginal stops, at least some of which are movably mounted on a track extending perpendicular to the direction of advance of the forms, these marginal stops determining the guide path for the forms and being capable of being set in pairs to fit the edges of the forms, and wherein at least some of the marginal stops have switching elements mounted thereon, functionally associated with the brake flaps, and the switching elements determine the individual association of the different brake flaps with forms being transported simultaneously and parallel to one another, depending on the position of the marginal stops on the track and wherein each switching element includes at least one switching contact and wherein in the path of movement of the switching contacts of the switching elements is mounted a control plate extending parallel to the path of movement and provided with control stages corresponding to the subdivision of the brake flaps, by means of which control stages the switching elements are actuated and hence the brake flaps are individually associated with the different form guiding paths.

18. Apparatus according to claim 17, comprising two pairs of marginal stops, defining two form guiding paths, wherein switching elements are mounted on the two inner marginal stops.

19. Apparatus according to claim 18, wherein the outer marginal stops of the two pairs of marginal stops are fixedly mounted and only the inner marginal stops carrying the switching elements are movable along a stepped control track of the control plate and can be set to the edges of the forms.

20. Apparatus according to claim 19, wherein a plurality of switching elements are associated with the individual control stages, the number of switching elements corresponding to the number of control stages, and the brake flaps are electrically connected to the inner marginal stops.

21. Apparatus according to claim 20, wherein the switching elements are provided with V-shaped contacts and are actuatable in two opposite directions and these contacts are electrically connected to the brake flaps.

* * * * *

UNITED STATES PATENT AND TRADEMARK OFFICE

CERTIFICATE OF CORRECTION

PATENT NO. : 4,167,346

DATED : September 11, 1979

INVENTOR(S) : Guentor Holland Letz

It is certified that error appears in the above-identified patent and that said Letters Patent are hereby corrected as shown below:

Column 4, line 42, delete "longitudnal" and insert --longitudinal-- therefor;

Column 5, line 55, delete "other" and insert --outer-- therefor;

Column 8, line 19, delete "falp" and insert --flap-- therefor.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*